US007605790B2

(12) United States Patent
Hsu

(10) Patent No.: US 7,605,790 B2
(45) Date of Patent: Oct. 20, 2009

(54) LIQUID CRYSTAL DISPLAY DEVICE CAPABLE OF REDUCING POWER CONSUMPTION BY CHARGE SHARING

(75) Inventor: Chin-Hung Hsu, Tao-Yuan Hsien (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 634 days.

(21) Appl. No.: 11/536,690

(22) Filed: Sep. 29, 2006

(65) Prior Publication Data

US 2008/0042957 A1 Feb. 21, 2008

(30) Foreign Application Priority Data

Aug. 16, 2006 (TW) ..... 95130137 A

(51) Int. Cl.
*G09G 3/30* (2006.01)

(52) U.S. Cl. ..... 345/92; 345/93

(58) Field of Classification Search ..... 345/92, 345/93, 63, 77, 215

See application file for complete search history.

(56) References Cited

U.S. PATENT DOCUMENTS

| | | | | |
|---|---|---|---|---|
| 5,867,139 | A * | 2/1999 | Tanaka et al. | 345/92 |
| 5,877,736 | A * | 3/1999 | Imajo et al. | 345/89 |
| 5,940,055 | A * | 8/1999 | Lee | 345/87 |
| 6,130,654 | A * | 10/2000 | Hayashi et al. | 345/63 |
| 6,891,521 | B2 * | 5/2005 | Park et al. | 345/87 |

* cited by examiner

*Primary Examiner*—Richard Hjerpe
*Assistant Examiner*—Olga Merkoulova
(74) *Attorney, Agent, or Firm*—Winston Hsu

(57) ABSTRACT

An LCD device includes a plurality of data lines, a plurality of gate lines, a plurality of display units, two dummy gate lines, and a plurality of dummy switches. When performing charge sharing during a positive driving period, the data lines are coupled to a positive voltage source via a corresponding dummy gate line and corresponding dummy switches. When performing charge sharing during a negative driving period, the data lines are coupled to a negative voltage source via a corresponding dummy gate line and corresponding dummy switches.

11 Claims, 5 Drawing Sheets

LIQUID CRYSTAL DISPLAY DEVICE CAPABLE OF REDUCING POWER CONSUMPTION BY CHARGE SHARING

BACKGROUND OF THE INVENTION

1. Field of the Invention

The present invention related to a liquid crystal display device, and more particularly, to a liquid crystal display capable of reducing power consumption by charge sharing.

2. Description of the Prior Art

Due to advantages such as low radiation, thin appearance and low power consumption, liquid crystal display (LCD) devices have gradually replaced traditional cathode ray tube (CRT) displays and been widely used in notebook computers, personal digital assistants (PDA), flat panel televisions or mobile phones.

Reference is made to FIG. 1 for a diagram of a prior art LCD device 10. The LCD device 10 includes an LCD panel 12, a timing controller 14, a source driver 16, and a gate driver 18. The LCD panel 12 includes a plurality of parallel data lines $D_1$-$D_m$, a plurality of parallel gate lines $G_1$-$G_n$, and a plurality of display units $P_{11}$-$P_{mn}$. The data lines $D_1$-$D_m$ intersect the gate lines $G_1$-$G_n$, and each of the display units $P_{11}$-$P_{mn}$ is disposed at the intersection of a corresponding data line and a corresponding gate line. The timing controller 14 can generate data signals corresponding display images, as well as control signals and clock signals for driving the LCD panel 12. Based on signals received from the timing controller 14, the source driver 16 and the gate driver 18 generate corresponding gate signals and driving signals, respectively. Each display unit of the LCD panel 12 includes a thin film transistor (TFT) switch and an equivalent capacitor. Each equivalent capacitor has an end coupled to a corresponding data line via a corresponding TFT switch, and another end coupled to a common voltage $V_{com}$ (Cs on common). When the TFT switch of a display unit is turned on by a gate signal generated by the gate driver 18, the equivalent capacitor of the display unit is electrically connected to its corresponding data line and can thus receive a driving voltage from the source driver 16. Therefore, the display unit can display images of various gray scales by changing the rotation of liquid crystal molecules based on charges stored in the equivalent capacitor.

With increasing demands in large-size applications, the panel loading and dynamic power consumption also increase as the LCD panel becomes larger. As a result, it is a main concern to lower power consumption when designing an LCD device. Generally speaking, in order to avoid permanent polarization of liquid crystal materials, the polarities of voltages applied to both ends of equivalent capacitors have to be reversed periodically. Common methods for driving LCD panels include dot inversion and line inversion. When the driving voltages of an LCD device begin to reverse respective polarities, the LCD device has the largest loading since the source driver consumes the largest amount of current at this point of time.

Charge sharing is normally applied for reducing power consumption in an LCD device. Charge sharing halves the amount of dynamic current by rearranging charges before the source driver outputs driving signals. In the prior art LCD device 10, the source driver 16 includes a plurality of output buffers 22 and a plurality of charge sharing switches 24. The source driver 16 can output driving signals to corresponding data lines via the output buffers 22. The charge sharing switches 24, each coupled between two neighboring data lines, are used for performing charge sharing. Assuming dot-inversion is used for driving the LCD panel 12 of the LCD device 10, among the driving voltages outputted by the source driver 16 to the data lines $D_1$-$D_m$, half of them are higher than the common voltage $V_{com}$, while the other half are lower than the common voltage $V_{com}$. In other words, during positive driving periods, the source driver 16 outputs a driving voltage $V_{PIXEL_POSITIVE}$ higher than the common voltage $V_{com}$ to odd-numbered date lines $D_1$-$D_{m-1}$, and outputs a driving voltage $V_{PIXEL_NEGATIVE}$ lower than the common voltage $V_{com}$ to even-numbered date lines $D_2$-$D_m$; during negative driving periods, the source driver 16 outputs the driving voltage $V_{PIXEL_NEGATIVE}$ to odd-numbered date lines $D_1$-$D_{m-1}$, and outputs the driving voltage $V_{PIXEL_POSITIVE}$ to even-numbered date lines $D_2$-$D_m$. The values of the driving voltages $V_{PIXEL_POSITIVE}$ and $V_{PIXEL_NEGATIVE}$ depend on the gray scales of display images, Before outputting the driving voltages, the prior art LCD device 10 turns on the charge sharing switches 24 in order to neutralize residual charges stored in the data lines at the end of previous driving periods. Reference is made to FIG. 2 for a diagram illustrating the voltage level of a liquid crystal capacitor in the LCD device 10. In FIG. 2, the transverse axle represents time, the vertical axle represents voltage level, $V_{MAX}$ and $V_{MIN}$ respectively represent the maximum and the minimum driving voltages outputted to the equivalent capacitor, and $V_{AVG}$ represents the voltage level of each data line after charge sharing. During the positive driving period, the driving voltage $V_{PIXEL_POSITIVE}$ outputted to the liquid crystal capacitor is between the common voltage $V_{com}$ and the maximum driving voltage $V_{MAX}$; during the negative driving period, the driving voltage $V_{PIXEL_NEGATIVE}$ outputted to the equivalent capacitor is between the common voltage $V_{com}$ and the minimum driving voltage $V_{MIN}$.

Assuming dot-inversion is used for driving the LCD panel 12 of the LCD device 10, the display units $P_{11}$ and $P_{12}$ are used for illustrations. In FIG. 2, the equivalent capacitor of the display unit $P_{11}$ has a voltage level $V_{PIXEL_NEGATIVE}$ equal to the minimum driving voltage $V_{MIN}$ and the equivalent capacitor of the display unit $P_{12}$ has a voltage level $V_{PIXEL_POSITIVE}$ equal to the maximum driving voltage $V_{MAX}$ at the end of the previous negative driving period (at T1). Before outputting driving voltages to the display unit $P_{11}$ during the current positive driving period (between T1 and T2), the prior art LCD device 10 turns on the charge sharing switch 24 coupled between the data lines $D_1$ and $D_2$ in order to neutralize residual charges stored in the corresponding data line at the end of the previous negative driving period. Therefore, the voltage level of the equivalent capacitor in the display unit $P_{11}$ is raised from $V_{PIXEL_NEGATIVE}$ to $V_{AVG}$. When $V_{PIXEL_POSITIVE}$ and $V_{PIXEL_NEGATIVE}$ are respectively equal to the maximum driving voltage $V_{MAX}$ and the minimum driving voltage $V_{MIN}$, $V_{AVG}$ is equal to the common voltage $V_{com}$. During the current positive driving period, the prior art LCD device 10 only needs to provide a voltage difference ΔVp to the display unit $P_{11}$. The value of ΔVp depends on the gray scale of images to be displayed by the display unit $P_{11}$, and can be represented by the following formula:

$$0 \leqq \Delta Vp = (V_{PIXEL_POSITIVE} - V_{AVG}) \leqq (V_{MAX} + V_{MIN})/2$$

Similarly, the equivalent capacitor of the display unit $P_{11}$ has a voltage level $V_{PIXEL_POSITIVE}$ equal to the maximum driving voltage $V_{MAX}$ and the liquid crystal capacitor of the display unit $P_{12}$ has a voltage level $V_{PIXEL_NEGATIVE}$ equal to the minimum driving voltage $V_{MIN}$ at the end of the previous positive driving period (at T2). Before outputting driving voltages to the display unit $P_{11}$ during the current negative driving period (between T2 and T3), the prior art LCD device 10 turns on the charge sharing switch 24 coupled between the data lines $D_1$ and $D_2$ in order to neutralize residual charges stored in the corresponding data line at the end of the previous positive driving period. Therefore, the voltage level of the equivalent capacitor in the display unit $P_{11}$ is decreased from $V_{PIXEL_POSITIVE}$ to $V_{AVG}$. When $V_{PIXEL_POSITIVE}$ and $V_{PIXEL_NEGATIVE}$ are respectively equal to the maximum driving voltage $V_{MAX}$ and the minimum driving voltage $V_{MIN}$, $V_{AVG}$ is equal to the common voltage $V_{com}$. During the current negative driving period, the prior art LCD device 10 only needs to provide a voltage difference ΔVn to the display unit $P_{11}$. The value of ΔVn depends on the gray scale of images to be displayed by the display unit $P_{11}$, and can be represented by the following formula:

$$0 \leqq \Delta Vn = (V_{AVG} - V_{PIXEL_NEGATIVE}) \leqq (V_{MAX} + V_{MIN})/2$$

Without charge sharing, the prior art LCD device 10 needs to provide a voltage difference ΔV to a display unit. The value of ΔV can be represented by the following formula:

$$0 \leqq |\Delta V| \leqq (V_{MAX} + V_{MIN})$$

Therefore, $$\Delta Vp \leqq |\Delta V| \text{ and } \Delta Vn \leqq |\Delta V|$$

The prior art LCD device 10 uses the charge sharing switches 24 for performing charge sharing. The power consumption can be reduced since the LCD device 10 only needs to provide display units with the voltage differences ΔVp and ΔVn, whose absolute values are smaller than that of the voltage difference ΔV. However, the charge sharing switches 24 are disposed on the source driver 16. Since a large number of charge sharing switches 24 are required in large-size applications and generate a lot of heat during charge sharing, the source driver 16 can encounter difficulties in heat dissipation.

SUMMARY OF THE INVENTION

The present invention provides an LCD device capable of reducing power consumption by charge sharing comprising a plurality of parallel data lines for receiving data signals corresponding to display images; a plurality of parallel gate lines intersecting the plurality of data lines for receiving gate signals; a plurality of storage units for storing data signals received from corresponding data lines; a plurality of data switches; a first dummy gate line parallel to the plurality of gate lines for receiving a first control signal; a plurality of first dummy switches; and a plurality of second dummy switches. The plurality of data switches each comprises a first end coupled to a corresponding storage unit; a second end coupled to a corresponding data line; and a control end coupled to a corresponding gate line, wherein the data switch electrically connects the corresponding storage unit to the corresponding data line or electrically isolates the corresponding storage unit from the corresponding data line based on a gate signal received from the corresponding gate line. The plurality of first dummy switches each comprises a first end coupled to a first power source; a second end coupled to a corresponding odd-numbered data line among the plurality of data lines; and a control end coupled to the first dummy gate line, wherein the first dummy switch electrically connects the first power source to the corresponding odd-numbered data line or electrically isolates the first power source from the corresponding odd-numbered data line based on the first control signal received from the first dummy gate line. The plurality of second dummy switches each comprises a first end coupled to a second power source; a second end coupled to a corresponding even-numbered data line among the plurality of data lines; and a control end coupled to the first dummy gate line, wherein the second dummy switch electrically connects the second power source to the corresponding even-numbered data line or electrically isolates the second power source from the corresponding even-numbered data line based on the first control signal received from the first dummy gate line.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
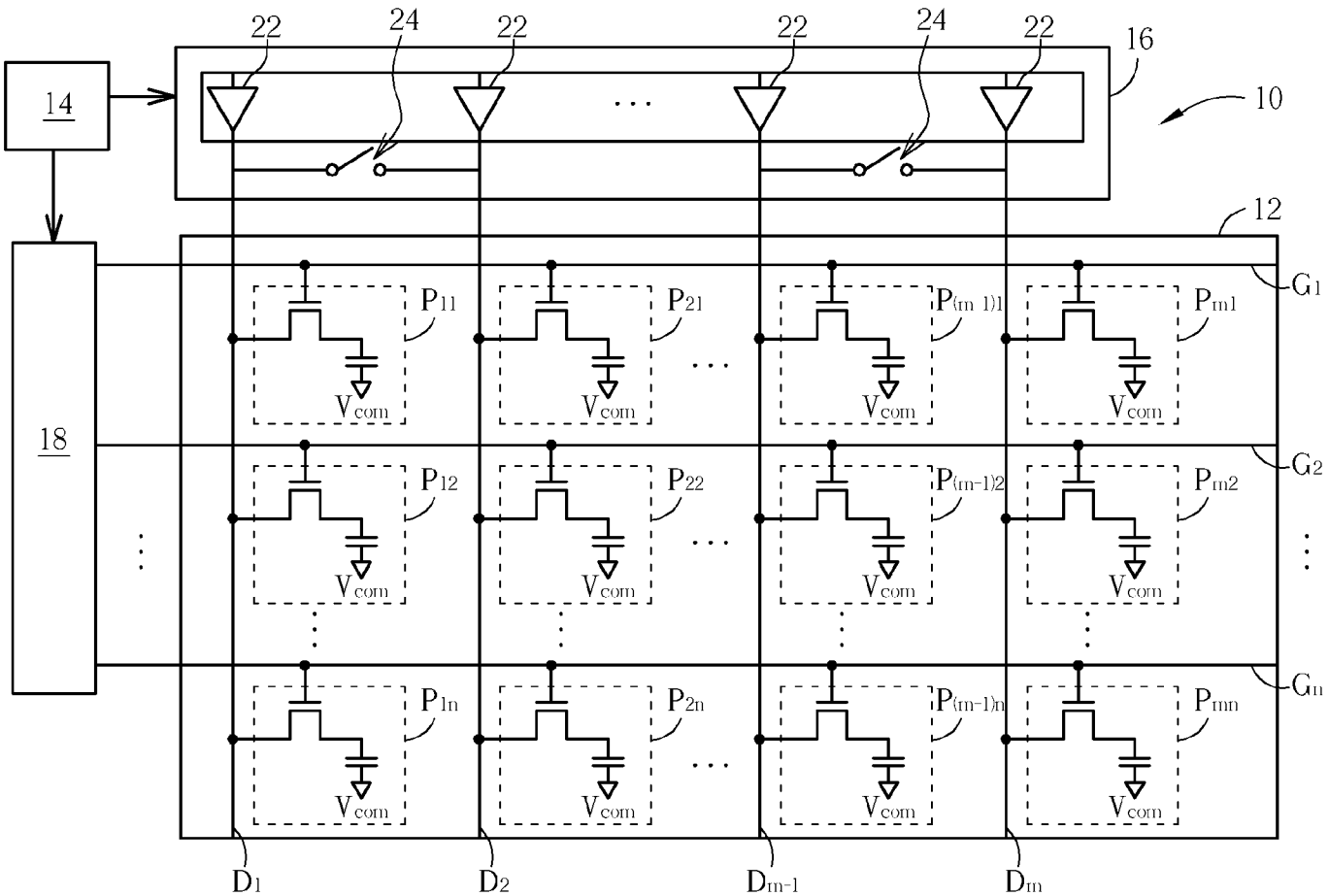
Fig. 1 Prior art
FIG. 1 is a diagram of a prior art LCD device.
Figure 2:
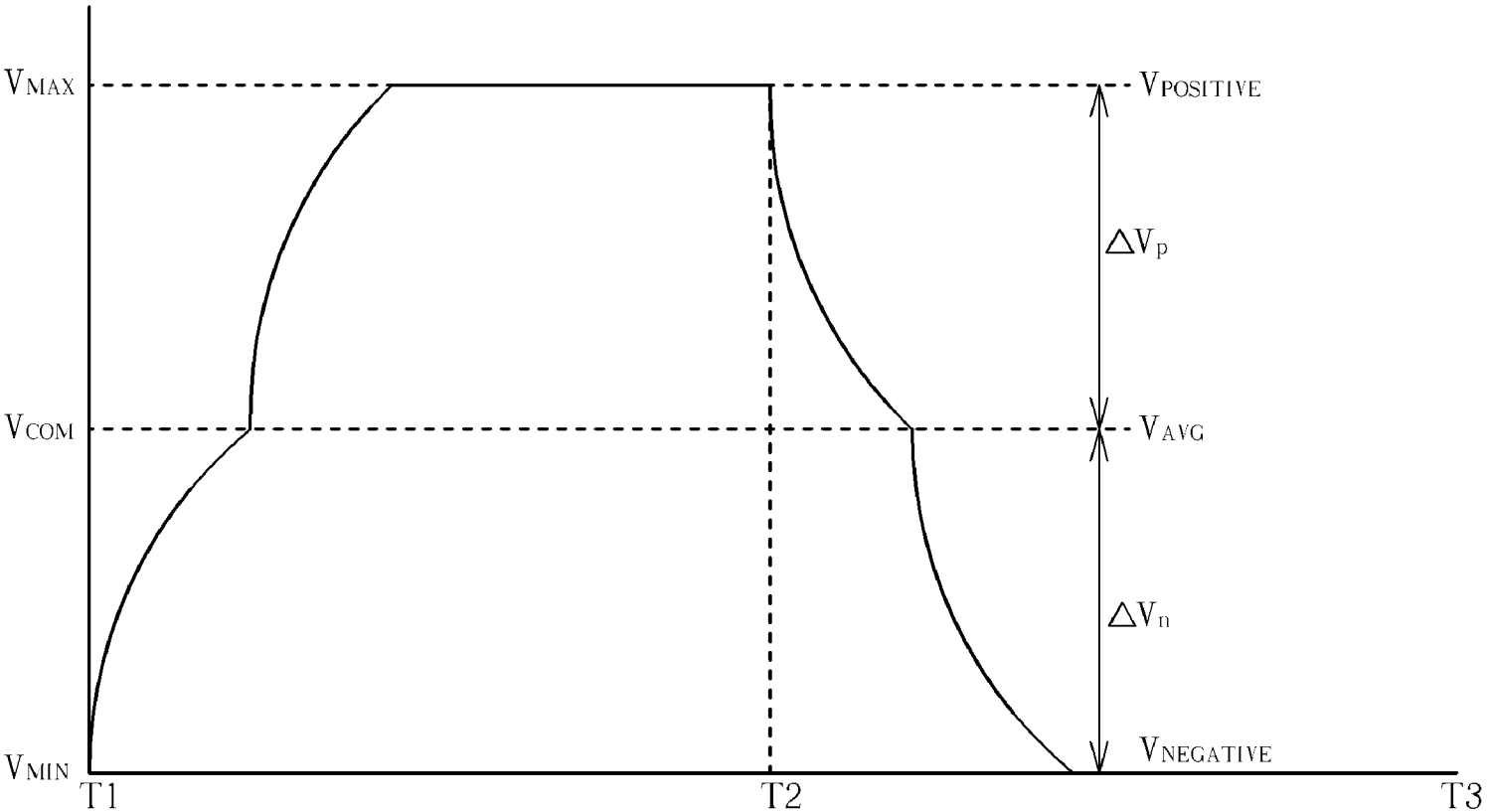
Fig. 2 Prior art
FIG. 2 is a diagram illustrating the voltage level of an equivalent capacitor in the LCD device of FIG. 1.
Figure 3:
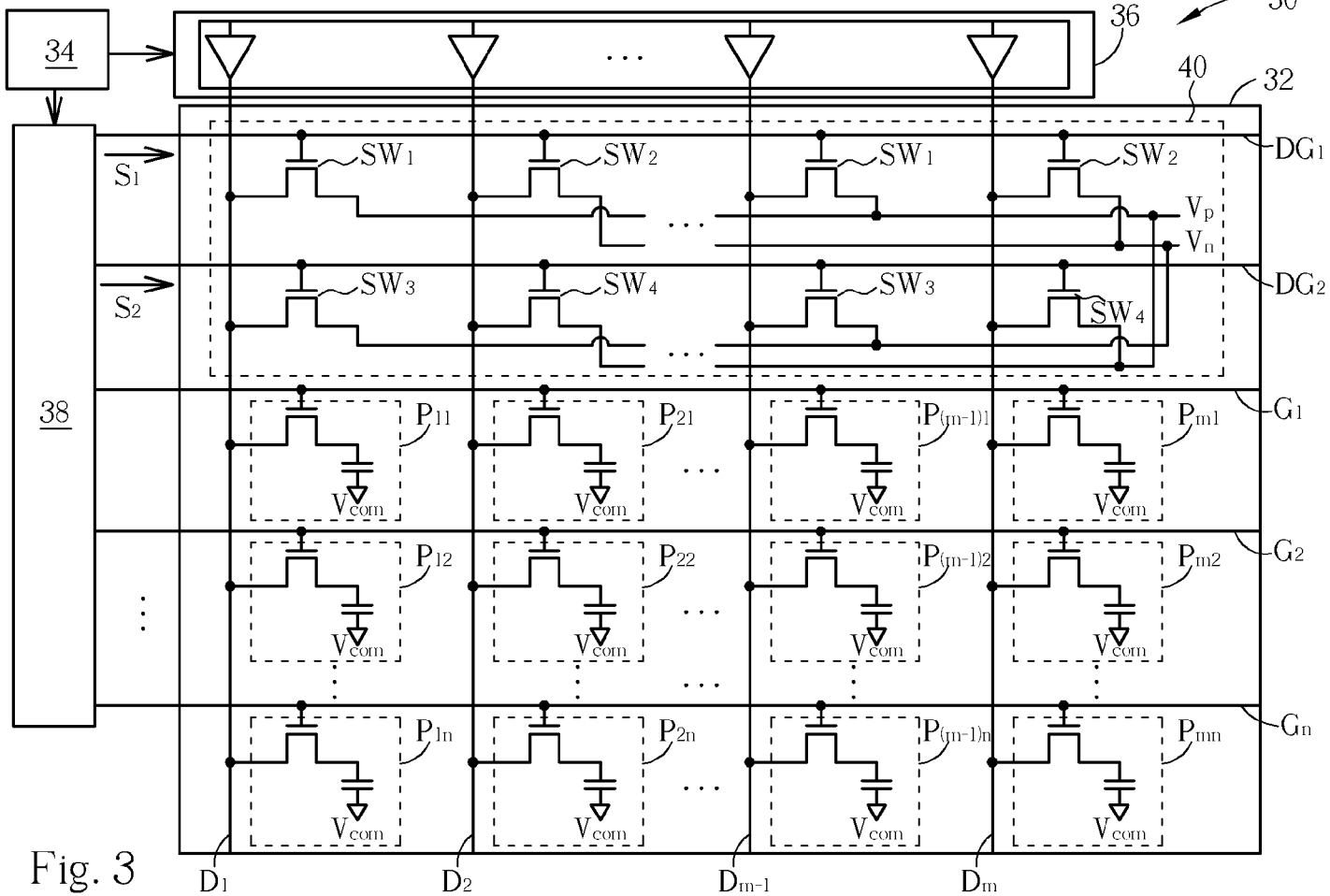
FIG. 3 is a diagram of an LCD device according to a first embodiment of the present invention.

Reference is made to FIG. 3 for an LCD device 30 according to a first embodiment of the present invention. The LCD device 30 includes an LCD panel 32, a timing controller 34, a source driver 36, and a gate driver 38. The LCD panel 32 includes a plurality of parallel data lines $D_1$-$D_m$, a plurality of parallel gate lines $G_1$-$G_n$, a charge sharing circuit 40, and a plurality of display units $P_{11}$-$P_{mn}$. The data lines $D_1$-$D_m$ intersect the gate lines $G_1$-$G_n$, and each of the display units $P_{11}$-$P_{mn}$ is disposed at the intersection of a corresponding data line and a corresponding gate line. The timing controller 34 can generate data signals corresponding display images, as well as control signals and clock signals for driving the LCD panel 32. Based on signals received from the timing controller 34, the source driver 36 and the gate driver 38 can generate corresponding gate signals and driving voltages, respectively. Each display unit of the LCD panel 32 includes a TFT switch and an equivalent capacitor. Each equivalent capacitor has an end coupled to a corresponding data line via a corresponding TFT switch, and another end coupled to a common voltage $V_{com}$. When the TFT switch of a display unit is turned on by a gate signal generated by the gate driver 38, the equivalent capacitor of the display unit is electrically connected to its corresponding data line and can thus receive a driving voltage from the source driver 36. Therefore, the display unit can display images of various gray scales by changing the rotation of liquid crystal molecules based on charges stored in the equivalent capacitor.

The charge sharing circuit 40 is disposed on the LCD panel 32 and includes a first dummy gate line $DG_1$, a second dummy gate line $DG_2$, and a plurality of first through fourth dummy switches $SW_1$-$SW_4$. The dummy gate lines $DG_1$ and $DG_2$, parallel to the gate lines $G_1$-$G_n$, can respectively receive a first control signal $S_1$ and a second control signal $S_2$ from the gate driver 38. Each of the first dummy switches $SW_1$ is coupled between a first power source $V_p$ and a corresponding odd-numbered data line ($D_1$, $D_3$, . . . , or $D_{m-1}$). When the first dummy switches $SW_1$ are turned on due to the first control signal $S_1$ applied to respective control ends via the first dummy gate line $DG_1$, the odd-numbered data lines $D_1$-$D_{m-1}$ are electrically connected to the first power source $V_p$. Each of the second dummy switches $SW_2$ is coupled between a second power source $V_n$ and a corresponding even-numbered data line ($D_2$, $D_4$, . . . , or $D_m$). When the second dummy switches $SW_2$ are turned on due to the first control signal $S_1$ applied to respective control ends via the first dummy gate line $DG_1$, the even-numbered data lines $D_2$-$D_m$ are electrically connected to the second power source $V_n$. Each of the third dummy switches $SW_3$ is coupled between the second power source $V_n$ and a corresponding odd-numbered data line ($D_1$, $D_3$, . . . , or $D_{m-1}$). When the third dummy switches $SW_3$ are turned on due to the second control signal $S_2$ applied to respective control ends via the second dummy gate line $DG_2$, the odd-numbered data lines $D_1$-$D_{m-1}$ are electrically connected to the second power source $V_n$. Each of the fourth dummy switches $SW_4$ is coupled between the first power source $V_p$ and a corresponding even-numbered data line ($D_2$, $D_4$, . . . , or $D_m$). When the fourth dummy switches $SW_4$ are turned on due to the second control signal $S_2$ applied to respective control end via the second dummy gate line $DG_2$, the even-numbered data lines $D_2$-$D_m$ are electrically connected to the first power source $V_P$.

Figure 4:
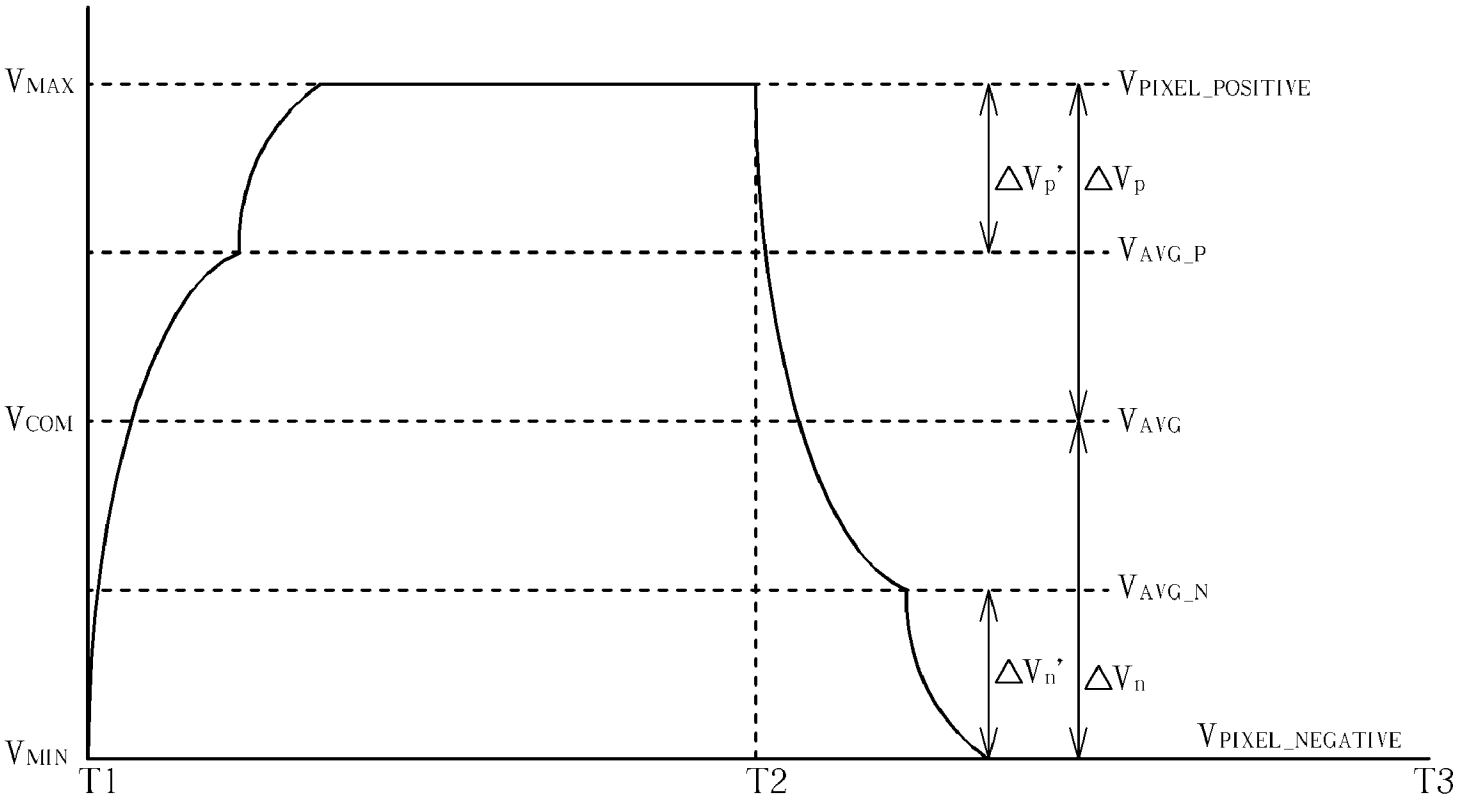
FIG. 4 is a diagram illustrating the voltage level of an equivalent capacitor in the LCD device of FIG. 3

The present invention reduces power consumption of a source driver using the charge sharing circuit 40 capable of adjusting the voltage level of each data line before outputting driving voltages to the LCD panel 32. Reference is made to FIG. 4 for a diagram illustrating the voltage level of an equivalent capacitor in the LCD device 30. In FIG. 4, the transverse axle represents time, the vertical axle represents voltage level, $V_{MAX}$ and $V_{MIN}$ respectively represent the maximum and the minimum driving voltages outputted to the liquid crystal capacitor, and $V_{AVG}$ represents the voltage level of each data line after charge sharing. During the positive driving period, the driving voltage $V_{PIXEL_POSITIVE}$ outputted to the equivalent capacitor is between the common voltage $V_{com}$ and the maximum driving voltage $V_{MAX}$; during the negative driving period, the driving voltage $V_{PIXEL_NEGATIVE}$ outputted to the equivalent capacitor is between the common voltage $V_{com}$ and the minimum driving voltage $V_{MIN}$.

The present invention controls the dummy switches of the charge sharing circuit 40 using the first control signal $S_1$ and the second control signal $S_2$. Assuming dot-inversion is used for driving the LCD panel 32 of the LCD device 30, the display units $P_{11}$ is used for illustrating the present invention. In FIG. 4, the liquid crystal capacitor of the display unit $P_{11}$ has a voltage level $V_{PIXEL_NEGATIVE}$ equal to the minimum driving voltage $V_{MIN}$ at the end of the previous negative driving period (at T1). Also, during the current positive driving period (between T1 and T2), the driving voltage $V_{PIXEL_POSITIVE}$ has to be provided to the data line $D_1$ so that the display unit $P_{11}$ can correctly display images. At this time, the first dummy switch SW1 coupled to the first dummy gate line $DG_1$ and the data line $D_1$ is turned on by applying the first control signal $S_1$ via the first dummy gate line $DG_1$, thereby electrically connecting the data line $D_1$ to the first power source $V_p$. With charge sharing between the first power source $V_p$ and the data line $D_1$, the voltage level of the data line $D_1$ can be raised to a voltage level $V_{AVG_P}$ equal to $(V_{PIXEL_NEGATIVE}+V_p)/2$. During the current positive driving period, the present LCD device 30 only needs to provide a voltage difference ΔVp' to the display unit $P_{11}$. The value of ΔVp' depends on the gray scale of images to be displayed by the display unit $P_{11}$, and can be represented by the following formula:

$$0 \leqq \Delta Vp' = (V_{PIXEL_POSITIVE} - V_{AVG_P}) \leqq \Delta Vp$$

Similarly, the liquid crystal capacitor of the display unit $P_{11}$ has a voltage level $V_{PIXEL_POSITIVE}$ equal to the maximum driving voltage $V_{MAX}$ at the end of the previous positive driving period (at T2). Also, during the current negative driving period (between T2 and T3), the driving voltage $V_{PIXEL_NEGATIVE}$ has to be provided to the data line $D_1$ so that the display unit $P_{11}$ can correctly display images. At this time, the third dummy switch SW3 coupled to the second dummy gate line $DG_2$ and the data line $D_1$ is turned on by applying the second control signal $S_2$ via the second dummy gate line $DG_2$, thereby electrically connecting the data line $D_1$ to the second power source $V_n$. With charge sharing between the second power source $V_p$ and the data line $D_1$, the voltage level of the data line $D_1$ can be lowered to a voltage level $V_{AVG_N}$ equal to $(V_{PIXEL_POSITIVE}+V_n)/2$. During the negative driving period, the present LCD device 30 only needs to provide a voltage difference ΔVn' to the display unit $P_{11}$. The value of ΔVn' depends on the gray scale of images to be displayed by the display unit $P_{11}$, and can be represented by the following formula:

$$0 \leqq \Delta Vn' = (V_{AVG_N} - V_{PIXEL_NEGATIVE}) \leqq \Delta Vn$$

In the first embodiment of the present invention, the first power source $V_p$ can be a positive voltage source, and the second power source $V_n$ can be a negative voltage source. During the positive driving periods, the present LCD device 30 performs charge sharing on the display units coupled to the odd-numbered data lines ($D_1$, $D_3$, . . . , and $D_{m-1}$) using the first dummy gate line $DG_1$, the first dummy switches $SW_1$ and the first power source $V_p$, and on the display units coupled to the even-numbered data lines ($D_2$, $D_4$, . . . , and $D_m$) using the second dummy gate line $DG_2$, the fourth dummy switches $SW_4$ and the first power source $V_p$. Therefore, the present invention can neutralize residual charges stored in the liquid crystal capacitors at the end of the previous negative driving period. Since the voltage level of a display unit is raised to $V_{AVG_P}$ after charge sharing, only a smaller voltage difference ΔVp' is required for the display unit and the power consumption can thus be reduced. Similarly, during the negative driving periods, the present LCD device 30 performs charge sharing on the display units coupled to the even-numbered data lines using the first dummy gate line $DG_1$, the second dummy switches $SW_2$ and the second power source $V_n$, and on the display units coupled to the odd-numbered data lines using the second dummy gate line $DG_2$, the third dummy switches $SW_3$ and the second power source $V_n$. Therefore, the present invention can neutralize residual charges stored in the data lines at the end of the previous positive driving period. Since the voltage level of a display unit is lowered to $V_{AVG_N}$ after charge sharing, only a smaller voltage difference ΔVn' is required for the display unit and the power consumption can thus be reduced from the source driver.

Figure 5:
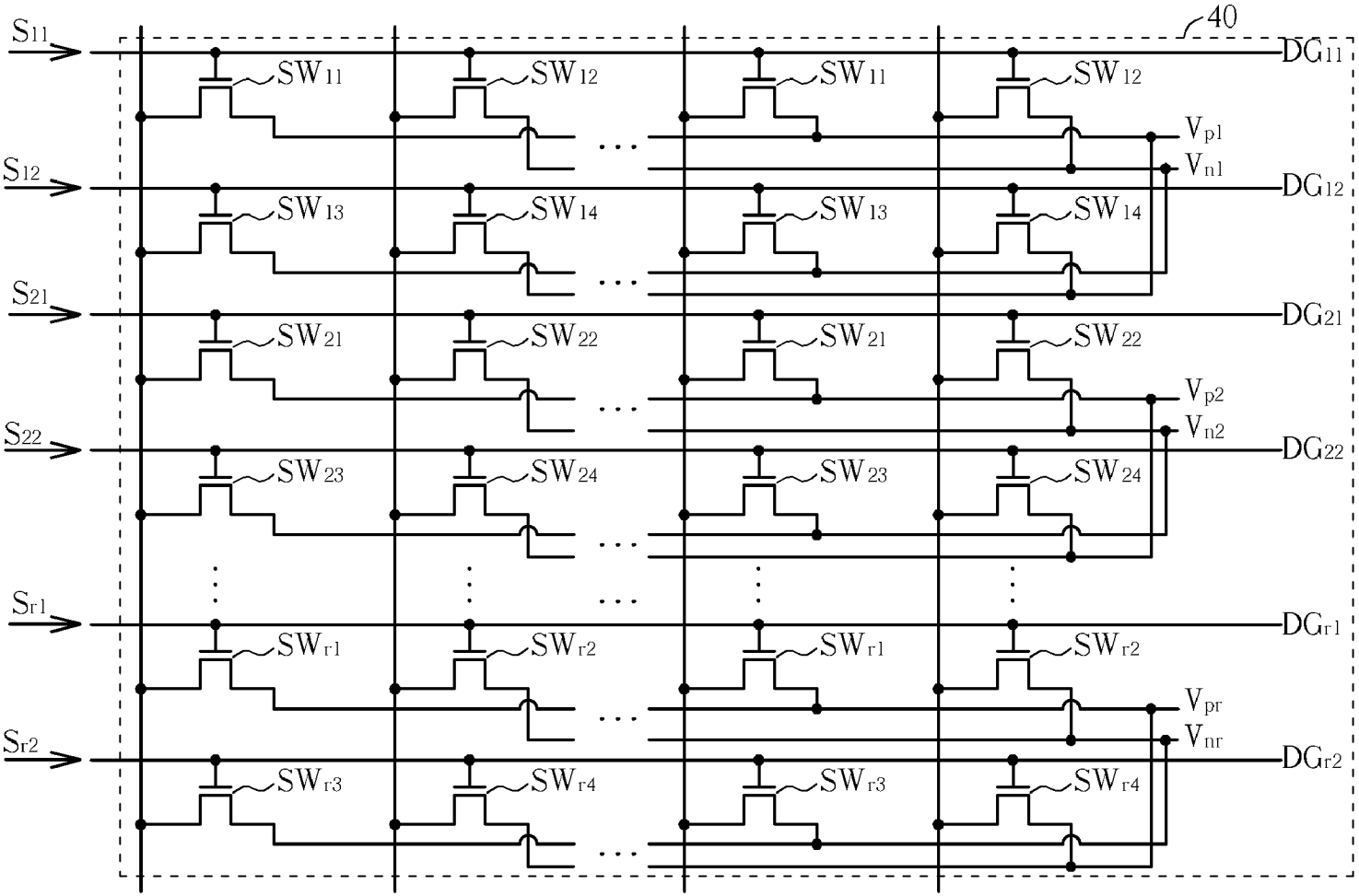
FIG. 5 is a diagram of a charge sharing circuit according to a second embodiment of the present invention.

Reference is made to FIG. 5 for a charge sharing circuit 40 according to a second embodiment of the present invention. Compared to the first embodiment, the charge sharing circuit 40 of the second embodiment includes a plurality of dummy gate lines $DG_{11}$-$DG_{r1}$ and $DG_{12}$-$DG_{r2}$, and a plurality of dummy switches $SW_{11}$-$SW_{14}$ through $SW_{r1}$-$SW_{r4}$. The dummy gate lines $DG_{11}$-$DG_{r1}$ and $DG_{12}$-$DG_{r2}$ can respectively receive control signals $S_{11}$-$S_{r1}$ and $S_{12}$-$S_{r2}$ from the gate driver 38. Each data line can be coupled to power sources $V_{p1}$-$V_{pr}$ or $V_{n1}$-$V_{nr}$ via corresponding dummy gate lines and dummy switches. In the second embodiment of the present invention, the power sources $V_{p1}$-$V_{pr}$ can be positive voltage sources, and the power sources $V_{n1}$-$V_{nr}$ can be negative voltage sources. During the positive driving periods, each data line can be coupled to the power sources $V_{p1}$-$V_{pr}$ having distinct levels, thereby raising a corresponding display unit to various voltage levels $V_{AVG_P1}$-$V_{AVG_Pr}$; during the negative driving periods, each data line can be coupled to the power sources $V_{n1}$-$V_{nr}$ having distinct levels, thereby lowering a corresponding display unit to various voltage levels $V_{AVG_N1}$-$V_{AVG_Nr}$. The voltage levels $V_{AVG_P1}$-$V_{AVG_Pr}$ and $V_{AVG_N1}$-$V_{AVG_Nr}$ depend on the values of the power sources $V_{p1}$-$V_{pr}$ and $V_{n1}$-$V_{nr}$. Therefore, the charge sharing circuit 40 of the second embodiment of the present invention can reduce power consumption of the source driver, as well as provide more flexible driving methods.

The LCD device 30 of the present invention performs charge sharing using the charge sharing circuit 40. Power consumption can further be reduced from the source driver by providing display units with a voltage difference ΔVp' whose absolute value is smaller than that of the voltage difference ΔVp, or a voltage difference ΔVn' whose absolute value is smaller than that of the voltage difference ΔVn. Also, the LCD device 30 can be driven flexibly in the present invention by raising a display unit to various voltage levels during the positive driving period, or by lowering a display unit to various voltage levels during the negative driving period. In addition, the charge sharing circuit 40 of the LCD device 30 is disposed on the LCD panel 32 having a larger area. The heat generated during charge sharing can easily be dissipated in large-size applications.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD) device capable of reducing power consumption of a source driver by charge sharing comprising:

a plurality of parallel data lines for receiving data signals corresponding to display images;

a plurality of parallel gate lines intersecting the plurality of data lines for receiving gate signals;

a plurality of storage units for storing data signals received from corresponding data lines;

a plurality of data switches each comprising:

a first end coupled to a corresponding storage unit;

a second end coupled to a corresponding data line; and a control end coupled to a corresponding gate line, wherein the data switch electrically connects the corresponding storage unit to the corresponding data line or electrically isolates the corresponding storage unit from the corresponding data line based on a gate signal received from the corresponding gate line; and a first dummy gate line parallel to the plurality of gate lines for receiving a first control signal;

a plurality of first dummy switches each comprising:

a first end coupled to a first power source;

a second end coupled to a corresponding odd-numbered data line among the plurality of data lines; and a control end coupled to the first dummy gate line, wherein the first dummy switch electrically connects the first power source to the corresponding odd-numbered data line or electrically isolates the first power source from the corresponding odd-numbered data line based on the first control signal received from the first dummy gate line; and a plurality of second dummy switches each comprising:

a first end coupled to a second power source;

a second end coupled to a corresponding even-numbered data line among the plurality of data lines; and a control end coupled to the first dummy gate line, wherein the second dummy switch electrically connects the second power source to the corresponding even-numbered data line or electrically isolates the second power source from the corresponding even-numbered data line based on the first control signal received from the first dummy gate line.

2. The LCD device of claim 1 wherein the first power source is a positive voltage source and the second power source is a negative voltage source.

3. The LCD device of claim 1 wherein the first power source is a negative voltage source and the second power source is a positive voltage source.

4. The LCD device of claim 1 further comprising:

a second dummy gate line parallel to the plurality of gate lines for receiving a second control signal;

a plurality of third dummy switches each comprising:

a first end coupled to the second power source;

a second end coupled to a corresponding odd-numbered data line among the plurality of data lines; and a control end coupled to the second dummy gate line, wherein the third dummy switch electrically connects the second power source to the corresponding odd-numbered data line or electrically isolates the second power source from the corresponding odd-numbered data line based on the second control signal received from the second dummy gate line; and a plurality of fourth dummy switches each comprising:

a first end coupled to the first power source;

a second end coupled to a corresponding even-numbered data line among the plurality of data lines; and a control end coupled to the second dummy gate line, wherein the fourth dummy switch electrically connects the first power source to the corresponding even-numbered data line or electrically isolates the first power source from the corresponding even-numbered data line based on the second control signal received from the second dummy gate line.

5. The LCD device of claim 4 wherein the first power source is a positive voltage source and the second power source is a negative voltage source.

6. The LCD device of claim 4 wherein the first power source is a negative voltage source and the second power source is a positive voltage source.

7. The LCD device of claim 4 wherein each dummy switch is a thin film transistor (TFT).

8. The LCD device of claim 1 wherein each data switch is a TFT.

9. The LCD device of claim 1 wherein each dummy switch is a TFT.

10. The LCD device of claim 1 wherein each storage unit includes an equivalent capacitor.

11. The LCD device of claim 1 further comprising:

a source driver for generating the data signals; and a gate driver for generating the gate signals.

* * * * *